United States Patent [19]

Russell

[11] Patent Number: 4,683,956

[45] Date of Patent: Aug. 4, 1987

[54] METHOD AND APPARATUS FOR OPERATING MULTIPLE TOOLS IN A WELL

[76] Inventor: Larry R. Russell, 6025 Edgemoor-Ste. C, Houston, Tex. 77081

[21] Appl. No.: 661,148

[22] Filed: Oct. 15, 1984

[51] Int. Cl.[4] ..... E21B 23/08; E21B 43/00

[52] U.S. Cl. ..... 166/383; 175/325

[58] Field of Search ..... 166/383, 217, 212, 140, 166/321, 330, 331, 374; 175/325, 267, 269

[56] References Cited

U.S. PATENT DOCUMENTS

| | | | |
|---|---|---|---|
| 3,123,162 | 3/1964 | Rowley | 175/325 |
| 3,400,773 | 9/1968 | Tiraspolsky et al. | 175/325 |
| 3,799,277 | 3/1974 | Kellner | 175/325 X |
| 3,986,554 | 10/1976 | Nutter | 166/240 X |
| 4,407,377 | 10/1983 | Russell | 175/325 |
| 4,491,187 | 1/1985 | Russell | 175/325 |

*Primary Examiner*—Stephen J. Novosad
*Assistant Examiner*—Thuy M. Bui
*Attorney, Agent, or Firm*—William A. Knox

[57] ABSTRACT

Apparatus and method for operating multiple tools connected serially in a pipe string in a well, each tool being operated by cyclic pressuring and depressuring of fluid in the pipe string from the surface, each tool having a part movable downward and upward by movements of a piston in response to said pressure cycles, said part movements being controlled by barrel cams which direct the part through a series of positions in response to a series of pressure cycles, the barrel cams of the tools being the same or different depending on the part position combinations desired, a series of pressure cycles moving the tool parts through the desired part position combinations for the multiple tools. Tool modifications making the multiple tool operations possible are also disclosed.

8 Claims, 6 Drawing Figures

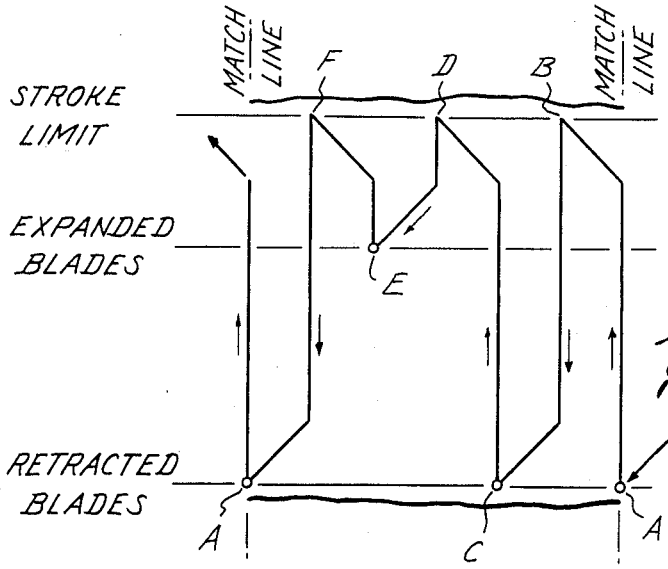
Fig. 2
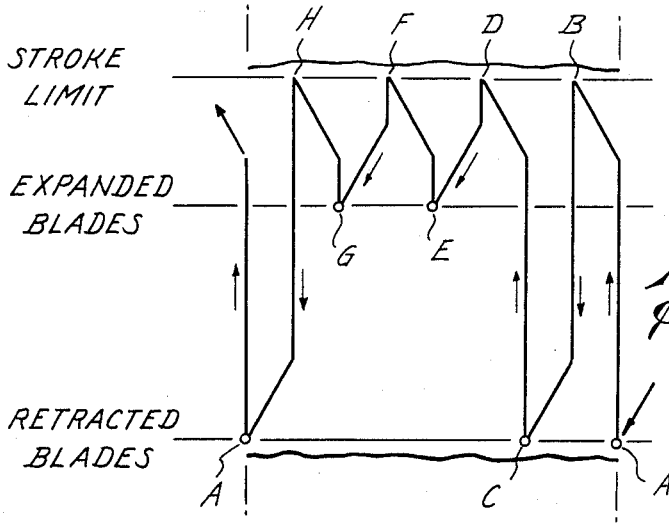
Fig. 3
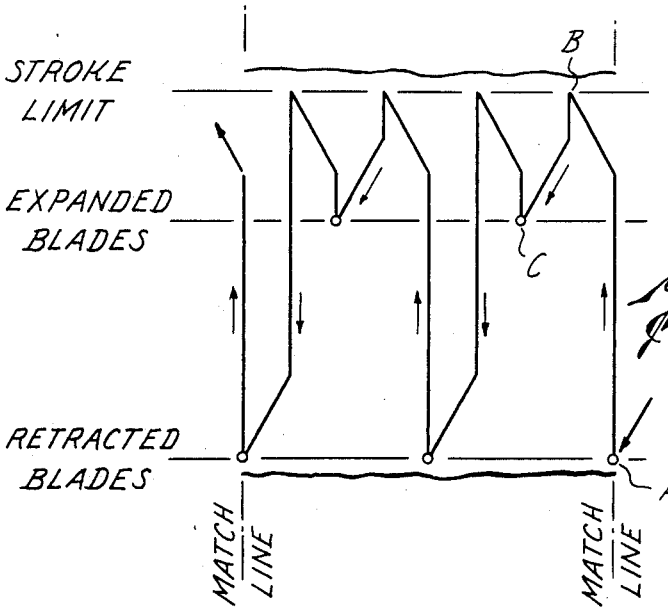
Fig. 4
Fig. 1
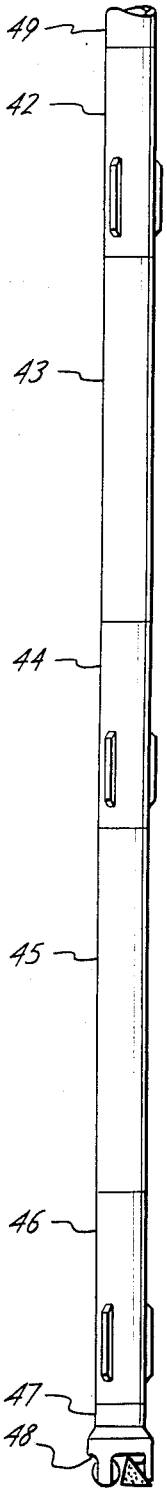

METHOD AND APPARATUS FOR OPERATING MULTIPLE TOOLS IN A WELL

BACKGROUND OF THE INVENTION

Blade stabilizers are useful in the drilling of inclined wells to control the inclination of drilling. Blade stabilizers are used connected into the drill string at a considerable distance below the earth surface, spaced above the drill bit. In order to install stabilizers in a drill string, or to modify their locations during drilling, it is necessary to withdraw the drill string from the well and to place the blade stabilizers where needed in the string, and then to rerun the drill string into the well. This is a very time consuming and expensive procedure. This invention seeks to provide blade stabilizer apparatus and methods by which the plural stabilizers may be connected into the drill string to be run into the hole with the drill string, and then actuated to be expanded or retracted at will, so that pulling and rerunning (so called round trips) of the drill string will not be necessary.

SUMMARY OF THE INVENTION

According to the invention, a plurality of retractable-expandable blade stabilizer apparatuses are connected into the drill string spaced above the bit, to be expanded to perform their stabilizer function only when required, and to be retracted at other times. Each of the blade stabilizers is of a type which is operated by cyclic increase and decrease of internal drill string pressure to be expanded or retracted as desired. The repeated cyclic pressuring-depressuring procedures will be referred to as pressuring cycles. Each blade stabilizer apparatus includes an assembly which operates as a piston to be moved downwardly when drill string pressure is increased and is biased to move upwardly when drill string pressure is decreased. Each blade stabilizer is controlled by a barrel cam which determines when the blades are expanded or retracted by the pressuring cycles. Pressuring of the drill string interior is accomplished from the surface, by means of a suitable pump or other fluid pressurizing device. According to the invention, by an appropriate series of pressure cycles, combined with a suitable combination of barrel cam designs, a plurality of stabilizers may be controlled from the surface, each to be expanded, retracted, or held expanded in a desired sequence of combinations.

A principal object of the invention is to provide apparatus and methods by which plural blade stabilizers in a drill string may be selectively expanded and retracted. Another object of the invention is to provide such apparatus and methods in which operation is controlled by cyclic pressuring and depressuring of the interior of the drill string. Yet another object of the invention is to provide such apparatus and methods in which plural blade stabilizers may be operated in different combinations of expanded stabilizers and retracted stabilizers, so that same may be employed in drill string directional deviation. Yet another object of the invention is to provide such apparatus and methods which are simple, easily carried out, and reliable.

Additional objects and advantages of the invention will appear from the following detailed description of preferred embodiments, reference being made to the accompanying drawings.

BRIEF DESCRIPTIONS OF THE DRAWINGS

FIG. 1 is a simplified side elevation showing the lower portion of a drill string having plural blade stabilizers incorporated therein.

FIGS. 2, 3, 4 are schematic drawings showing exemplary shapes of barrel cams which may be employed in the blade stabilizers shown in FIG. 1.

DESCRIPTIONS OF THE PREFERRED EMBODIMENTS

Figure 5:
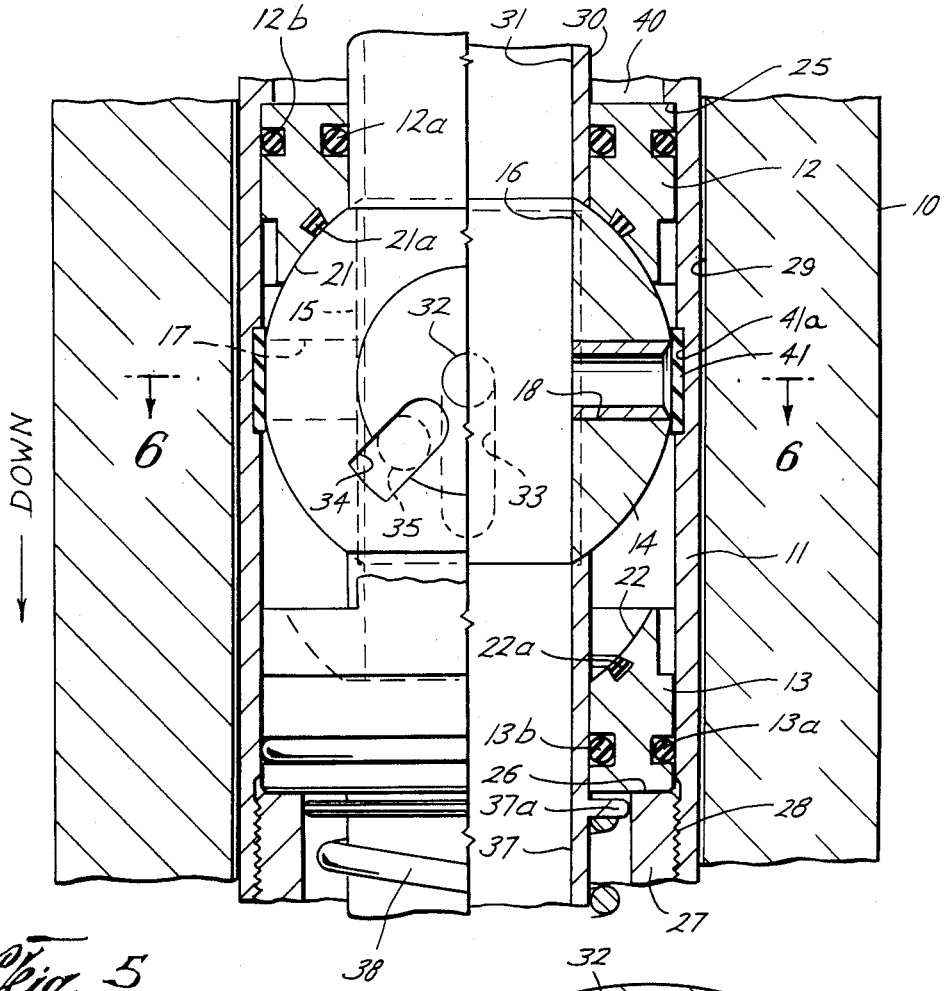
FIG. 5 is a vertical axial cross section, partly in quarter section, showing a modification of blade stabilizer apparatus useful with the invention.
Figure 6:
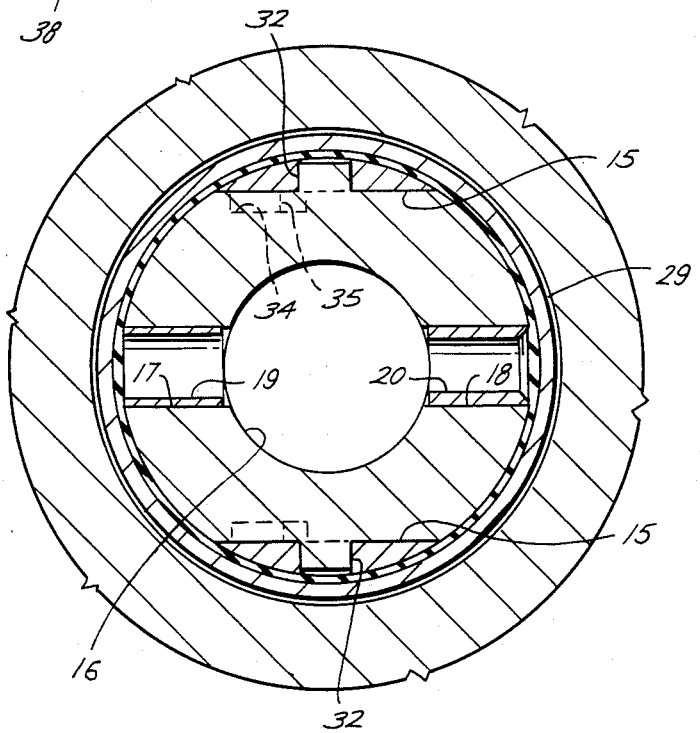
FIG. 6 is a horizontal cross section taken at line 6—6 of FIG. 5.

Referring now to the drawings in detail, and first to FIGS. 1, 5 and 6, blade stabilizers of the type referred to herein are disclosed and claimed in U.S. patent application Ser. No. 368,996, filed Apr. 16, 1982, now U.S. Pat. No. 4,407,377, and Ser. No. 508,814 filed June 29, 1983 now U.S. Pat. No. 4,491,187, the latter being attorney's file P-623. Both of these blade stabilizers are operated by increasing internal drill string pressure to drive down a piston assembly which in turn drives down a blade expander to expand the blades which are disposed in radial slots. The expander is controlled by a barrel cam which controls the lengths of downward and upward movements of the blade expander, according to the barrel cam pattern. On some downward strokes of the expander, the expander is moved fully downward and on some subsequent return strokes the expander is moved fully upward and on other subsequent return strokes the expander is moved partway downward and partway upward, all according to the barrel cam pattern. In application Ser. No. 368,996, referred to above, a ball valve is closed by increase of internal drill string pressure to create an effective piston for driving the expander downward. In the apparatus according to application Ser. No. 508,814, (P-623), the ball valve is omitted and the piston assembly is driven down by increased drill string pressure because of its larger upper surface area. In each of these apparatuses, an accumulator is provided to hold pressured fluid, such as pressured nitrogen gas, for biasing the piston in an upward position and for returning it to an upward position after it has been moved downwardly. In each case, a compression spring is also provided for the same purpose. These complete apparatuses are not shown in the disclosure of this application, and the showings of FIGS. 5 and 6 relate to the ball valve arrangement of application Ser. No. 368,996, the ball valve being modified to permit plural tool operations.

Referring to FIGS. 5–6, the tool has an outer upper housing body 10 within which is disposed a sleeve 11 slightly spaced inwardly of body 10. Seat rings 12, 13 above and below ball valve 14, are connected at opposite sides by longitudinal bars 15. Ball valve 14 has flow port 16 therethrough. Opposite smaller flow passages 17, 18 diametrically intersect flow passage 16. Passage 17 is a flow inlet passage, and is lined by a relatively thinner walled liner sleeve 19. Passage 18 is an outlet flow passage and is lined by a relatively thicker liner sleeve 20. O-ring seals 12*a*, 12*b* are provided inward and outward of seat ring 12, and O-ring seals 13*a*, 13*b* are provided inward and outward of seat ring 13.

Seat ring 12 has a spherically shaped downwardly facing seat 21 having a circular sealing ring 21*a* disposed in a circular groove therearound. Sealing ring 13 has an upwardly facing spherically formed seat 22 around which is disposed a circular sealing ring 22*a* in a groove therearound. Seat rings 12 and 13, connected by opposite axially disposed bars 15 at opposite sides of ball 14 are positioned in sleeve 11 between a downwardly facing shoulder 25 of sleeve 11 and an upwardly facing end 26 of lower body member 27, which is connected to body member 10 at threaded connection 28. An annular space 29 between body 10 and sleeve 11 is filled with a lubricating fluid such as oil introduced through a port (not shown) through body 10. A piston sleeve 30 bears at its spherically formed lower end against the upper side of ball 14, and is more completely shown in said application Ser. No. 368,996. When piston 30 is moved downwardly by increased pressure within the drill string and within passage 31 of piston sleeve 30, ball 14 is moved downwardly and is rotated 90° to closed position. Ball 14 has projecting cylindrical formations 32 at opposite sides thereof, each formation 32 sliding in an axial groove 33 in a bar 15 as the ball moves down. Ball 14 has opposite slots 34, formed as shown, which are engaged by pins 35, one at each side of the ball carried by the opposite bars 15.

The pin 35 engagements in slots 34 are what cause rotation of the ball as the ball is moved downwardly. Upward movement of the ball causes ball rotation in the opposite direction to its original position. When the ball is rotated by downward movement of the ball caused by downward movement of piston 30, the ball rotates in a clockwise direction as it is seen in FIG. 5, so that inlet port 17 moves to an upward position and outlet port 18 moves to a downward position. The ball valve, therefore, is not completely closed, but permits flow therethrough through said inlet and outlet passages 17 and 18. This flow is, of course, restricted, as compared to the flow when the valve is opened with passage 16 in line with sleeve 30. A sleeve 37 bears at its spherically formed upper end against the lower side of ball 14, and has an outwardly formed integral collar 37*a* thereround below seat ring 13. A helical compression spring 38 bears upwardly against collar 37*a*.

Piston sleeve 30 is biased upwardly by pressured fluid, such as for example pressured nitrogen gas within a reservoir space 40 formed around piston sleeve 30, and by the upward bias of spring 38, acting through sleeve 37 and ball 14. The increased drill string pressure to force piston sleeve 30 downwardly must, of course, be sufficient to overcome the upward biases of the pressured fluid in accumulator 40 and the upward bias of compression spring 38. When the internal drill string pressure is decreased, the accumulator fluid bias and the spring 38 bias will return piston sleeve 30, ball 14 and sleeve 37 to their upwardly moved positions.

Member 27 at a lower portion thereof, not shown, has cut in its outer surface a barrel cam groove, not shown. The groove is engaged by a pin carried by body member 10 so that when member 27 is moved downwardly it is controlled in movement by the shape of the cam groove. Referring to FIGS. 2–4 of the drawings, showing three exemplary barrel cam groove patterns, the respective member 27 is initially in an upward position with the pin carried by body portion 10 at point A of the respective cam groove. Downward movement of member 27 causes the pin to move to position C of the cam groove. Repeated pressure cycles of the internal drill string pressure causes the pin to move successively along the cam groove to positions D, E, etc., until after a complete revolution of member 27 the pin arrives again at groove position A. Additional pressure cycles start another movement of the pin through the successive groove positions. In each complete transit of the pin along the groove, the member 27 is rotated by 360°, so that each point A of the barrel cam groove shown in each of FIGS. 2–4 is the same position.

Connected to the lower end of member 27, there is provided a stabilizer blade expander sleeve which when moved downwardly with member 27 causes an expansion of the stabilizer blades and which when moved upwardly with member 27 permits retraction of the stabilizer blades, all as more fully explained in application Ser. No. 368,996. The blades are expanded by the movement of outwardly thickened portions of the expander sleeve riding over inwardly thickened portions of the blades to force the blades outwardly. The blades are spring biased inwardly, so that when the outwardly formed thickened portions of the expander sleeve are moved off of the inwardly thickened portions of the blades, the springs may move the blades inwardly.

A soft rubber ring 41 is disposed in a circular groove 41*a* at the interior of sleeve 11 at the levels of the ports 17, 18 when the ball is in the position shown in FIG. 5 of the drawings. Ring 41, which bears lightly on the ball, blocks the cross ports to prevent trash build up outside of the ball.

As has been explained earlier, there are two types of expandable blade stablizer apparatuses with which this invention is primarily concerned. One of the apparatuses is disclosed in application Ser. No. 368,996, filed Apr. 16, 1982, and the other of the apparatuses is disclosed in application Ser. No. 508,814, filed June 29, 1983 (Attorney's file P-623). One of the apparatuses has a ball valve which is closed to form a piston assembly for pressured downward movement of the blade expander sleeve, and the other apparatus does not have a ball valve in its mechanism. The above described modified ball valve is to be substituted for the ball valve shown in application Ser. No. 368,996. Hereinafter, during the course of the remaining description, one of the apparatus will be referred to as the modified ball valve type of apparatus, and the other apparatus will be referred to as the non-ball valve type apparatus.

FIG. 1 of the drawings shows the lower end of a drill string in schematic form. Pipe 49 is the lower end of a drill string extending downwardly into the well from the surface. Element 42 is an expandable blade stabilizer of either the modified ball valve type or the non-ball valve type. Element 43 is a pipe length formed by one or more drill collars connected to the lower end of stabilizer 42. Element 44 is an expandable blade stabilizer of the modified ball valve or non-ball valve type. Element 45 is a drill pipe string section formed by one or more drill collars connected at the lower end of stabilizer 44. Element 46 is an expandable blade stabilizer of either the modified or unmodified ball valve type or the non-ball valve type connected to the lower end of drill collar 45. Element 47 is a drill string section formed by one or more drill collars, and element 48 is a drill bit. The drill collar lengths shown in the drawings are not meant to be limiting, as the drill collar lengths may be of any suitable lengths desired for the job in process. It should also be understood that, during drilling, drilling fluid is normally circulated down through the drill string to the bit and then upwardly around the drill collars and drill string to the surface.

When either two or three blade stabilizers are used in a drill string in the manner shown in FIG. 1, the multiple blade stabilizers can be provided in the following arrangements:

(A) An arrangement with both or all of the blade stabilizers being of the modified ball valve type, with the accumulator or trigger pressures increasing upwardly.

(B) An arrangement with the stabilizer tools both or all being of the non-ball valve type, with the same or somewhat different accumulator or trigger pressures.

(C) An arrangement with the bottom stabilizer tool being either of the modified ball valve type or of the non-modified ball valve type, and with the upper blade stabilizer or stabilizers being of the non-ball valve type, and with accumulator or trigger pressures all the same or increasing upwardly.

The variation of the drill string deviational tendencies for directional drilling is typically produced by adding or removing conventional blade stabilizers in the drill string and by varying their locations along the length of the drill string. This procedure requires a round trip withdrawal and rerunning of the drill string to change the stabilizer assembly. By varying the barrel cam patterns for expandable blade stabilizer tools in the drill string, the same result can be achieved without a round trip withdrawal and re-running of the drill string. Any of the three blade stabilizer combinations A, B, C, above, may be satisfactorily used. Table 1 shows the barrel cam patterns for use with two blade stabilizers in the stabilizer drill string arrangement, sometimes called the bottom hole assembly (BHA), and indicates how the tools can be expanded and retracted to yield any desired combination of blade stabilizer expansions or retractions. Table 2 shows the barrel cam patterns for use when three blade stabilizers are included in the drill string as shown in FIG. 1. Naturally, if it is desired to have any pair or more of the blade stabilizers expanded or retracted simultaneously, then the stabilizers should be provided with the same barrel cam pattern. Extension of the method to more than three blade stabilizers having more than three separate barrel cam patterns is possible, but is not likely to be required for the typical drilling situation.

TABLE 1

CAM PATTERNS & BLADE POSITIONS FOR 2 TOOLS IN BHA

E: TOOL 46 - FIG. 4 PATTERN
TOOL 44 - FIG. 3 PATTERN
IN = BLADES RETRACTED
OUT = BLADES EXPANDED

| NO. OF PRESSURE CYCLES | BLADE STATUS TOOL 46 | BLADE STATUS TOOL 44 | |
|---|---|---|---|
| 0 (AS RUN IN HOLE) | IN | IN | |
| 1 | OUT | IN | Pattern Repeats Every 4 Cycles |
| 2 | IN | OUT | |
| 3 | OUT | OUT | |
| 4 | IN | IN | |

TABLE 2

CAM PATTERNS & BLADE POSITIONS FOR 3 TOOLS IN BHA

USE TOOL 46 - FIG. 4 PATTERN
TOOL 44 - FIG. 3 PATTERN
TOOL 42 - FIG. 2 PATTERN
IN = BLADES RETRACTED
OUT = BLADES EXPANDED

| NO. OF PRESSURE CYCLES | BLADE STATUS TOOL 46 | BLADE STATUS TOOL 44 | BLADE STATUS TOOL 42 | |
|---|---|---|---|---|
| 0 (AS RUN IN HOLE) | IN | IN | IN | PATTERN REPEATS EVERY 12 CYCLES |
| 1 | OUT | IN | IN | |
| 2 | IN | OUT | OUT | |
| 3 | OUT | OUT | IN | |
| 4 | IN | IN | IN | |
| 5 | OUT | IN | OUT | |
| 6 | IN | OUT | IN | |
| 7 | OUT | OUT | IN | |
| 8 | IN | IN | OUT | |
| 9 | OUT | IN | IN | |
| 10 | IN | OUT | IN | |
| 11 | OUT | OUT | OUT | |
| 12 | IN | IN | IN | |

Thus, according to the invention, by using different barrel cam patterns in different combinations of expandable blade stabilizers, as described above, all of the stabilizers in a bottom hole assembly can be made to simultaneously increment one cam rest position for each circulation pressure cycle above the required trigger value. Since the drill cam patterns are purposefully different (by having different periods and/or adjacent cam expanded positions and/or retracted positions, for the individual stabilizers, all of the permutations of expanded-retracted can be obtained within a reasonable number of pressure cycles.

While preferred embodiments of the invention have been described and shown in the drawings, many modifications thereof may be made by a person skilled in the art without departing from the spirit of the invention, and it is intended to protect by Letters Patent all forms of the invention falling within the scope of the following claims.

I claim:

1. A bottom-hole assembly for use in a bore hole, comprising:

a drill string including a plurality of segments;

a plurality of spaced-apart well tools interconnected in serial order between segments of said drill string, including a lowermost well tool, in fluid communication with said drill string;

means for providing fluid pressure to said drill string and said well tools, including means for cyclically increasing and decreasing the fluid pressure to produce programmed sequences of cyclic pressure increments and decrements; and a barrel cam mounted within, and associated with, each said well tool, the barrel cam being slidably disposed for motion within each said well tool in response to said cyclic pressure increments and decrements for the purpose of actuating said well tool, each said barrel cam including a cam groove characterized by a unique cam-groove pattern and a fixed cam follower for engaging said cam groove, each individual barrel cam, by reason of its unique cam-groove pattern, being responsive in its motions to a programmed sequence of said cyclic pressure increments and decrements for selectively actuating its associated well tool simultaneously with others of the plurality of well tools in selected operative combinations of said plurality of well tools.

2. The assembly as defined by claim 1, comprising:

a piston slidably disposed for upward and downward and rotary motion in response to cyclic pressure decrements and increments respectively, mounted within each said well tool;

an accumulator in each said well tool containing a fluid under a preselected pressure for upwardly biasing said piston; and a ball valve, operatively coupled between said piston and said barrel cam, slidably disposed within said lowermost well tool, said ball valve being movable to open and closed configurations in response to respective upward and downward motions of said piston, said ball valve including a flow-restrictive means therethrough when in the closed configuration, to provide fluid flow through others of the serially-ordered well tools.

3. The assembly as defined by claim 2, wherein said preselected accumulator pressure is greater than the ambient drilling-fluid pressure and the magnitude of said pressure increments and decrements are referenced to the preselected accumulator pressure.

4. The assembly as defined by claim 1, wherein unrestricted fluid communication is provided through all of the serially-interconnected well tools except the lowermost well tool.

5. The assembly as defined by claim 2, wherein said restrictive flow means allows flow through said plurality of spaced-apart well tools when said ball valve fails in a closed configuration.

6. The assembly as defined by claim 4, wherein said well tool comprises an expandable-blade stabilizer.

7. The assembly as defined in claim 6, wherein the expandable blade stabilizer further comprises:

a plurality of blades mounted in axial slots in each said well tool;

spring means for inwardly biasing said blades; and an expander sleeve operatively coupled to said piston for forcing said stabilizer blades outwardly in response to a cyclic pressure increment.

8. The assembly as defined by claim 5, wherein said ball valve is closed by a cyclic pressure increment so that the effect of said cyclic pressure increment in moving said piston and said expander sleeve is amplified.

* * * * *